US005305880A

United States Patent [19]

Wilk et al.

[11] Patent Number: 5,305,880

[45] Date of Patent: Apr. 26, 1994

[54] RETRACTABLE TOOL ASSEMBLY

[76] Inventors: Marilyn M. Wilk; Peter J. Wilk, both of 185 W. End Ave., New York, N.Y. 10023

[21] Appl. No.: 928,275

[22] Filed: Aug. 11, 1992

Related U.S. Application Data

[63] Continuation-in-part of Ser. No. 917,596, Jul. 23, 1992.

[51] Int. Cl.[5] ..... B65D 85/00; E03D 9/00

[52] U.S. Cl. ..... 206/349; 4/255.11

[58] Field of Search ..... 4/255.02, 255.03, 255.07, 4/255.05, 255.11, 255.12; 81/490; 206/15.2, 15.3, 349, 361; 312/42, 45, 206; 401/109, 112, 113, 117

[56] References Cited

U.S. PATENT DOCUMENTS

| | | | |
|---|---|---|---|
| 470,777 | 3/1892 | Billings | 81/490 |
| 1,244,798 | 10/1917 | Tharp et al. | 401/117 |
| 1,701,771 | 2/1929 | Stefano | 401/109 |
| 2,233,157 | 2/1941 | Cahn et al. | 206/361 |
| 4,211,750 | 7/1980 | Gillespie | 206/361 |
| 4,432,451 | 2/1984 | Hooser . | |
| 4,776,456 | 10/1988 | Lewis . | |
| 4,922,555 | 5/1990 | Bonilla et al. . | |
| 4,991,987 | 2/1991 | Holloway et al. | 401/117 |
| 5,040,679 | 8/1991 | Rehmann . | |
| 5,048,989 | 9/1991 | Stageman | 401/109 |
| 5,114,006 | 5/1992 | Wilk | 206/349 |

FOREIGN PATENT DOCUMENTS

| | | | |
|---|---|---|---|
| 622195 | 6/1961 | Canada . | |
| 611145 | 5/1979 | Switzerland . | |
| 0450916 | 7/1936 | United Kingdom | 401/109 |
| 658710 | 10/1951 | United Kingdom . | |

*Primary Examiner*—Jimmy G. Foster

*Attorney, Agent, or Firm*—R. Neil Sudol; Henry D. Coleman

[57] ABSTRACT

A household implement comprises a tool member including (i) an operative element, (ii) an elongate rod attached at one end to the operative element, and (iii) a bar shaped flange connected to the rod at an end opposite the operative element, the bar extending substantially orthogonally with respect to the rod. The implement additionally comprises a hollow housing having a longitudinal axis, an opening at one end and a hand grip at an opposite end. A first locking mechanism is provided at the end of the housing where the hand grip is located. The first locking mechanism cooperates with the flange, upon a rotation of the tool member from a retracted neutral position, to releasably hold the tool member in a retracted locked position to the housing. A second locking mechanism is provided at the one end of the housing, near the opening in the housing, for cooperating with the flange, upon a rotation of the tool member from an extended neutral position, to releasably hold the tool member in an extended locked position to the housing.

26 Claims, 6 Drawing Sheets

RETRACTABLE TOOL ASSEMBLY

CROSS-REFERENCE TO RELATED APPLICATION

This application is a continuation-in-part of application Ser. No. 917,596 filed Jul. 23, 1992.

BACKGROUND OF THE INVENTION

This invention relates to a tool assembly. More particularly, this invention relates to an assembly for a household implement such as a bathroom plunger.

Most households have at least one bathroom plunger for removing blockages in drains. Frequently, particularly in those houses having limited storage space or in those houses having pronounced drainage difficulties, plungers sit in open view, beneath the sink or beside the bathtub. Generally, because of their functional design, plungers are not especially pleasant to view. Accordingly, it would be useful to enclose the plunger in an appropriately sized housing, by which means the plunger would still remain easily accessible for immediate use in case of emergency.

Plungers are also unsanitary implements, inasmuch as little care is generally taken to clean them. Such implements are therefore a source of disease bacteria for young children who inhabit floor spaces and are not adverse to intimate tactile association with whatever objects are on the floor.

OBJECTS OF THE INVENTION

An object of the present invention is to provide a household implement such as a plunger or brush device with a housing for hiding the implement from view.

Another, more particular object of the present invention is to provide such a plunger or brush device with a housing having any of a variety of decorative shapes.

Another object of the present invention is to provide a tool assembly, for use as a household implement such as a bathroom plunger, wherein a housing or casing also serves as a holder.

Yet another object of the present invention is to provide such a tool assembly which serves to maintain sanitary conditions and to prevent young children from playing with household implements which may carry infectious bacteria or viruses.

These and other objects of the invention shall be apparent from the detailed descriptions and illustrations hereof.

SUMMARY OF THE INVENTION

A household implement comprises, in accordance with one conceptualization of the present invention, a tool member including an operative element and a rod attached at one end to the operative element, a hollow housing having an opening at one end and a hand grip at an opposite end, and mounting elements for mounting the tool member to the housing for slidable motion between a retracted position inside the housing and an extended position wherein the operative element and a portion of the rod are outside of the housing. The household implement further comprises locking elements on the housing for releasably locking the tool member in the extended position. The locking elements include a pair of arrests extending inwardly from opposite sides of an inner surface of the housing. The arrests define a pair of abutment surfaces disposed essentially in a common plane oriented transversely with respect to the housing, the abutment surfaces being spaced from one another in the common plane. A bar is connected to the rod at an end thereof opposite the operative element. The bar extends orthogonally to the rod and has a length greater than a distance between the abutment surfaces and a width less than that distance.

In accordance with a particular embodiment of the present invention, the arrests are shelf-like flanges and the bar is one of a pair of bars connected to the rod at an end thereof opposite the operative element. Each of the bars extends orthogonally to the rod and has a length greater than the distance between the abutment surfaces. Moreover, each of the bars has a width less than that distance, whereby the bars define a slot for receiving the arrests in a locked configuration of the implement.

In accordance with another particular embodiment of the present invention, the arrests are elongate cylindrical segments extending along the opposite sides of the housing. The abutment surfaces are then surfaces of the cylindrical segments oriented transversely with respect to the housing. Additional locking elements on the housing for locking the tool member in the retracted position include on the arrests a pair of additional abutment surfaces extending inwardly from opposite sides of the inner surface of the housing. Like the first abutment surfaces, the additional abutment surfaces are disposed essentially in a common plane oriented transversely with respect to the housing and are spaced from one another in such common plane by an additional distance less than the length of the bar and greater than the width of the bar.

In this second embodiment of the invention, the locking element for holding the tool member in the extended configuration or position further includes an arresting element preferably in the form of a ring for preventing the bar from moving more than a predetermined distance beyond the locking elements in a direction opposite the hand grip.

In accordance with yet another particular embodiment of the present invention, the arrests comprise a first pair of shelf-like flanges projecting inwardly on opposite sides of the housing. Additional locking elements on the housing for locking the tool member in the retracted position then comprise a pair of additional shelves or flanges extending inwardly from opposite sides of an inner side of the housing. The additional shelves or flanges are disposed essentially in a common plane oriented transversely with respect to the housing and are spaced from one another in such common plane by an additional distance less than the length of the bar and greater than the width of the bar.

Preferably, the housing is cylindrical with a cylindrical inner surface, while the bar has a rectangular cross-section.

The tool member may take the form, for example, of a plunger, the operative element being a cup-shaped resilient member.

A household implement comprises, in accordance with a further conceptualization of the present invention, a tool member including (i) an operative element, (ii) an elongate rod attached at one end to the operative element, and (iii) a bar connected to the rod at an end opposite the operative element, the bar extending substantially orthogonally with respect to the rod. The implement further comprises a hollow housing having an opening at one end and a hand grip at an opposite end and a longitudinal axis. First locking elements are provided at the hand grip end of the housing for cooperating with the bar, upon a rotation of the tool member from a retracted neutral position, to releasably hold the tool member in a retracted locked position to the housing, while second locking elements are provided at the open end of the housing for cooperating with the bar, upon a rotation of the tool member from an extended neutral position, to releasably hold the tool member in an extended locked position to the housing.

Pursuant to another feature of this second conceptualization of the present invention, at least one of the first locking elements and the second locking elements includes a pair of arrests extending inwardly from opposite sides of an inner surface of the housing. The arrests define a pair of abutment surfaces disposed essentially in a common plane oriented transversely with respect to the housing. The abutment surfaces are spaced from one another in the common plane, while the bar has a length greater than a distance between the abutment surfaces and a width less than that distance.

As discussed hereinabove, the arrests may take the form of shelves or shelf-like flanges or, alternatively, cylindrical segments. An additional arresting element or elements may be provided for preventing the bar on the tool member from moving more than a predetermined distance beyond the second locking elements in a direction opposite the hand grip. The additional arresting element may take the form of a pair of additional shelves or shelf-like flanges or, alternatively, a ring or annular shelf.

Pursuant to an alternative feature of the present invention, the bar flange is the only bar flange attached to the rod. In that event, at least one of the first locking mechanism and the second locking mechanism includes a pair of first shelves extending inwardly from opposite sides of an inner surface of the housing and a pair of second shelves extending inwardly from opposite sides of an inner surface of the housing. The first shelves are disposed essentially in a common plane oriented transversely with respect to the housing and are spaced from one another in that common plane, while the second shelves are similarly disposed essentially in a common plane oriented transversely with respect to the housing and are spaced from one another in that common plane. The single bar has a length greater than a distance between the shelves of each pair of shelves and a width less than that distance.

A method for executing a household chore comprises, in accordance with the present invention, the steps of (a) lifting up a housing by a handle provided at an upper end thereof, (b) extending, from an opening in a lower end of the housing, a tool member disposed inside the housing prior to the step of lifting, (c) rotating the tool member with respect to the housing, (d) upon the step of rotating, locking, to formations on opposite sides of the housing, opposite ends of a bar connected to the tool member and extending transversely relative to the housing, (e) manipulating the housing and the tool member via the handle to perform a task to which the tool member is adapted, (f) upon completion of the task, again rotating the tool member with respect to the housing, thereby unlocking the tool member from the housing, (g) retracting the tool member back into the housing, and (h) placing the housing upon a horizontal surface so that the opening is covered and the tool member is again contained inside the housing.

Pursuant to another feature of the present invention, the method also comprises the step of rotating the tool member with respect to the housing prior to the step of extending, thereby unlocking the tool member from the housing. This additional rotation may be executed when the housing is lifted a short distance from a horizontal surface, thereby using friction to maintain the tool member in a relatively stationary position during a manual twisting of the housing.

Pursuant to another feature of the present invention, where the bar is one of two bars attached to the tool member at one end thereof and extending parallel to one another, the step of locking includes the step of inserting between the bars, at opposite ends thereof, flanges extending inwardly from opposite sides of an inner surface of the housing.

DETAILED DESCRIPTION

Figure 1:
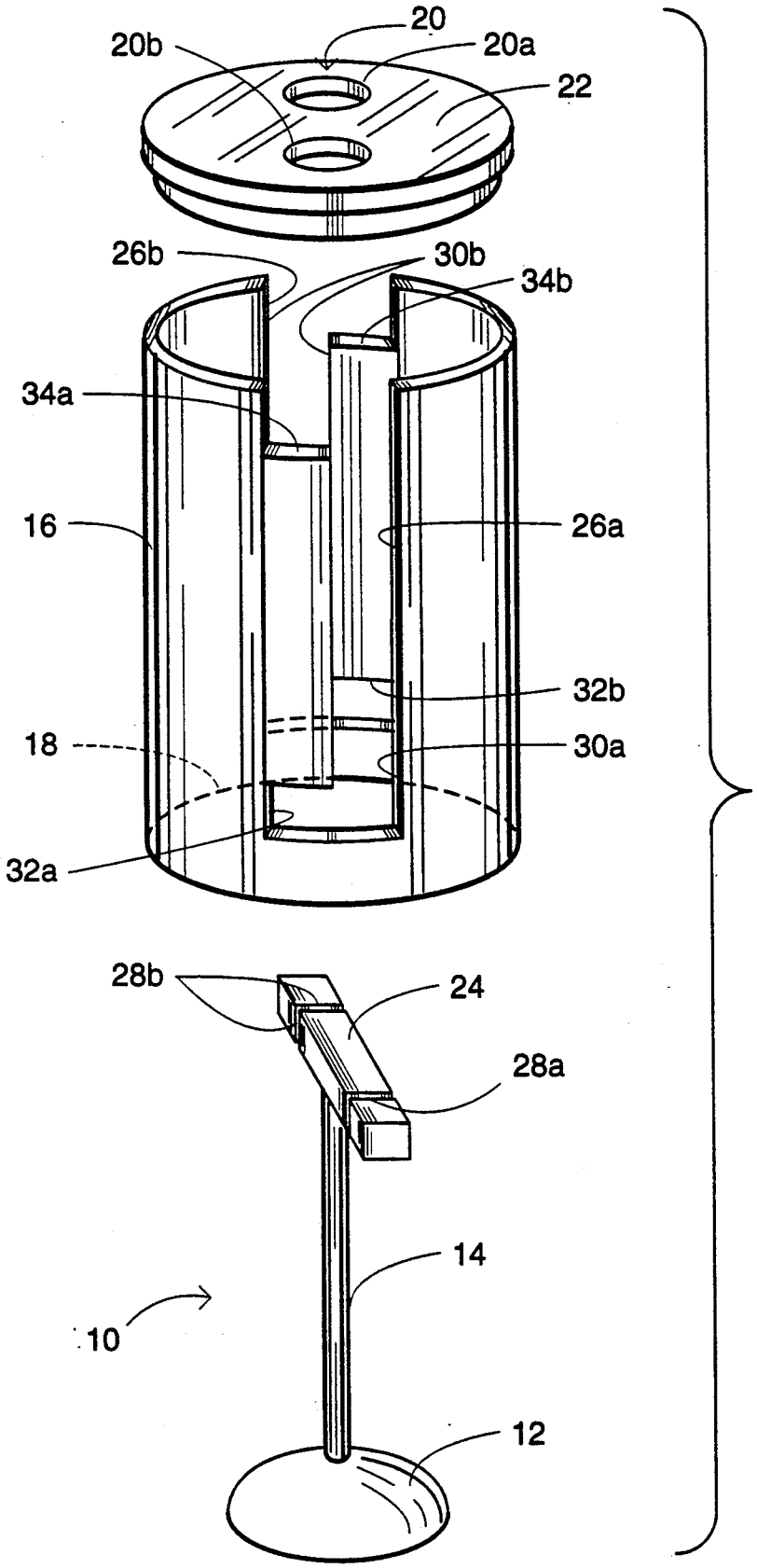
FIG. 1 is a schematic exploded perspective view of a plunger and casing assembly in accordance with the present invention.

As illustrated in FIG. 1, a household implement comprises a tool member 10 specifically including an operative element 12 in the form of a cup-shaped resilient plunger head and an elongate rod 14 attached at one end to plunger head 12. Tool member 10 is slidably mounted to a hollow housing 16 having an opening 18 at a lower end and a hand grip 20 at an upper end. Hand grip 20 comprises a pair of rounded parallel slots 20*a* and 20*b* disposed in a cover plate 22 attached to housing 16 at the upper end thereof.

Tool member 10 shifts or reciprocates relative to housing 16 between a retracted position inside housing 16 (FIGS. 2A and 2B) and an extended position (FIG. 2D) wherein plunger head 12 and a portion of rod 14 are outside of housing 16. To that end, rod 14 is provided at an upper end, opposite plunger head 12, with a transversely extending and cross-sectionally rectangular bar or elongate flange 24, while housing 16 is provided with a pair of longitudinally extending slots 26*a* and 26*b* traversed by bar 24. During reciprocation or shifting of tool member 10 relative to housing 16, bar 24 slides along slots 26*a* and 26*b*. To prevent rotation of tool member 10 about a transverse axis during longitudinal or axial reciprocation of the tool member relative to housing 16, bar 24 may be provided along its sides with grooves 28*a* and 28*b* into which edges 30*a* and 30*b* of slots 26*a* and 26*b* fit.

Slots 26*a* and 26*b* are provided at lower ends with oppositely extending circumferential extensions or side slots 32*a* and 32*b* and at upper ends with additional oppositely extending circumferential extensions of side slots 34*a* and 34*b*. Lower circumferential extensions 32*a* and 32*b* communicate with longitudinally extending slots 26*a* and 26*b* for providing a means for locking tool member 10 in the extended position shown in FIG. 2D, thereby facilitating use of the tool member 10 to unclog a toilet bowl or drain. Upper circumferential extensions 34*a* and 34*b* similarly communicate with longitudinally extending slots 26*a* and 26*b* for providing a means for locking tool member 10 in the retracted position shown in FIGS. 2A and 2B, thereby permitting housing 16 to be lifted and carried to another location while maintaining tool member 10 in the retracted position inside the housing.

The rectangular cross-section of bar 24 facilitates locking of tool member 10 relative to housing 16. The edges of bar 24 provide torque against undesired turning of tool member 10 relative to housing 16.

Figure 2A:
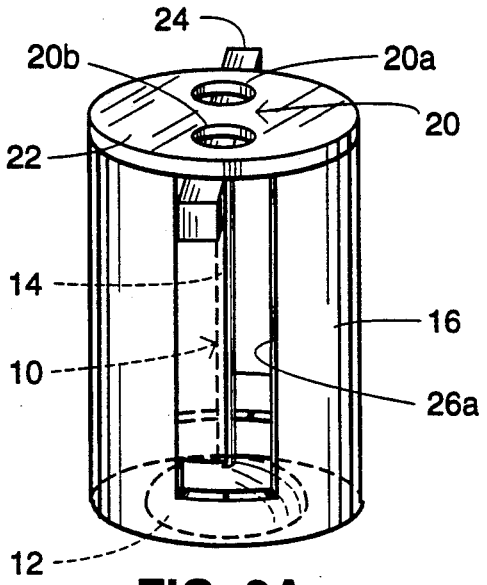
FIGS. 2A-2D are schematic perspective views of the plunger and casing assembly of FIG. 1 in an assembled configuration, showing successive stages in the use of the assembly.
Figure 2B:
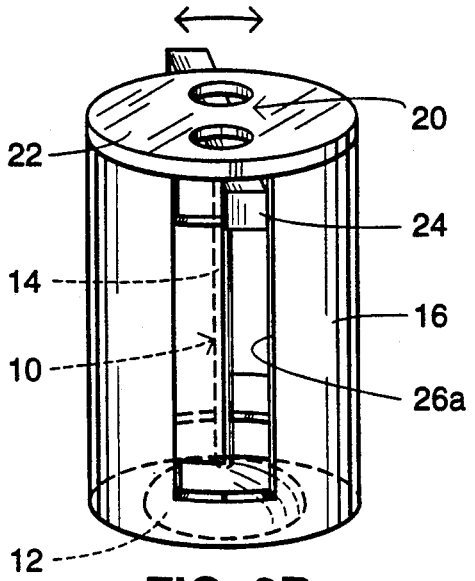

FIG. 2A shows the household implement of FIG. 1 in an assembled, storage configuration. To use the implement, housing 16 is grasped via handle or hand grip 20. Housing 16 is then lifted slightly off of the floor so that it no longer rests on the floor and so that plunger head 12 remains resting on the floor surface. A torque is then applied to housing 16 via hand grip 20 to turn housing 16 relative to tool member 10. Tool member 10 remains stationary relative to the floor surface but rotates relative to housing 16, whereby bar 24 is brought out of the upper circumferential slot extensions 34*a* and 34*b* into the upper ends of longitudinal slots 26*a* and 26*b*, as illustrated in FIG. 2B. It is to be noted that upper circumferential slot extensions 34*a* and 34*b* are sufficiently wider than bar 24, in the axial or vertical direction, to permit an elevation of housing 16 without a frictional engagement between bar 24 and edges of slot extensions 34*a* and 34*b*.

Figure 2C:
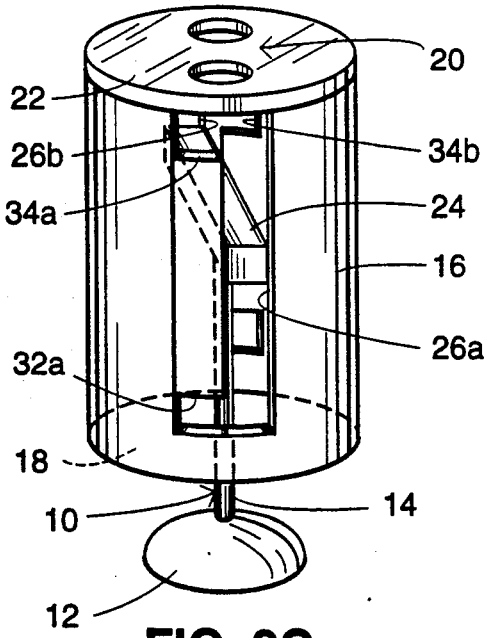
Figure 2D:
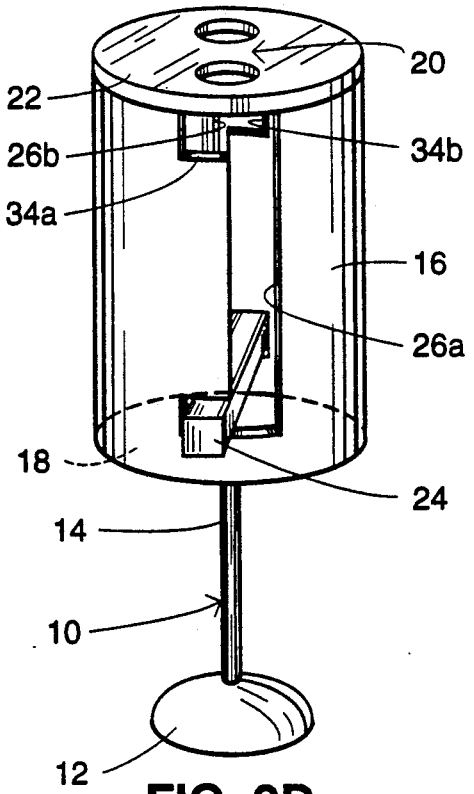

Upon a rotation of housing 16 and tool member 10 relative to one another, as depicted in FIG. 2B, hand grip 20 is used to further lift housing 16 relative to tool member 10. While housing 16 is raised, plunger head 12 remains resting on the floor surface while bar 24 slides down longitudinal slots 26*a* and 26*b*. From opening 18 in housing 16, tool member 10 emerges, plunger head 12 first, as illustrated in FIG. 2C. Upon a completed extension of tool member 10 relative to housing 16, i.e., upon the reaching of the bottoms of slots 26*a* and 26*b* by bar 24, plunger housing 16 is again twisted so that the free ends of bar 24 enter lower circumferential slot extensions 32*a* and 32*b*, as illustrated in FIG. 2D, thereby locking tool member 10 in an extended position to housing 16. Housing 16 and tool member 10 are then manipulated via hand grip or handle 20 to clear a drain or toilet bowl. Subsequently, plunger head 20 is placed into contact with a floor surface and the above-described steps are repeated in reverse in order to bring tool member 10 again into a retracted position inside housing 16. It is to be noted that during the entire operation, it is not necessary to touch tool member 10. Only hand grip 20 need be grasped.

As illustrated in FIGS. 3A-3D, a household implement comprises a tool member 40 including an operative element 42 in the form of a cup-shaped resilient member, an elongate rod or shaft 44 attached at one end to cup member 42, and a pair of bar shaped flanges 46 and 48 connected to rod 44 at an end opposite cup member 42, the bars extending substantially orthogonally or transversely with respect to rod 44. The implement of FIGS. 3A-3D additionally comprises a hollow housing or casing 50 having a longitudinal axis 52, an opening 54 at one end and a hand grip 56 in the form of a pair of slots or apertures 56*a* and 56*b* provided in a transversely oriented plate or panel 58 at an end of housing 50 opposite opening 54.

Figure 3A:
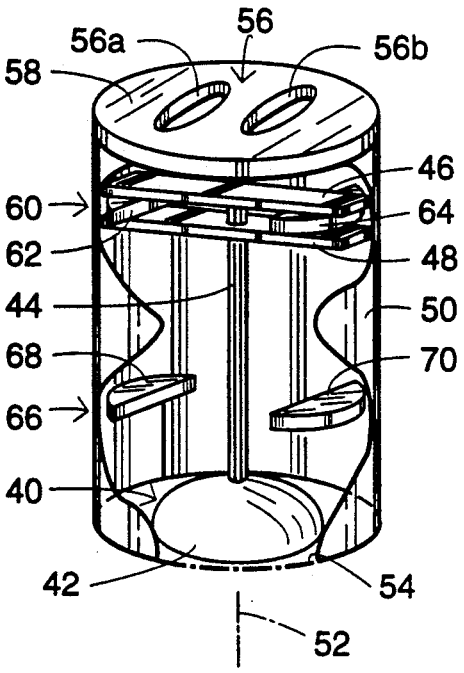
FIGS. 3A-3D are schematic perspective views, partially broken away, of another plunger and casing assembly in accordance with the present invention, showing successive stages in the use of the assembly.

A first locking mechanism 60 is provided at the upper end of housing 50 proximately to hand grip 56. Locking mechanism 60 cooperates with bars 46 and 48 upon a rotation of tool member 40 from a retracted neutral position (FIG. 3B), to releasably hold tool member 40 in a retracted locked position to housing 50 (FIG. 3A). Locking mechanism 60 includes a pair of arrests in the form of shelves or inwardly projecting flanges 62 and 64 extending inwardly from opposite sides of an inner surface of housing 50. Shelves 62 and 64 are disposed essentially in a common plane oriented transversely with respect to housing 50 and axis 52. Shelves 62 and 64 are spaced from one another in the common plane. Bars 46 and 48 each have a length greater than a distance d1 between shelves 62 and 64 and a width less than that distance. The upper surfaces of shelves 62 and 64, i.e., the surfaces facing plate 58, are abutment surfaces which engage upper bar 46 to prevent tool member 40 from falling out of the retracted position upon a shifting of the assembly from one storage location to another.

A second locking mechanism 66 is provided at the lower end of housing 50 proximately to opening 54. Locking mechanism 66 cooperates with bars 46 and 48 upon a rotation of tool member 40 from an extended neutral position (FIG. 3C), to releasably hold tool member 40 in an extended locked position to housing 50 (FIG. 3D). Locking mechanism 66 includes a pair of arrests in the form of shelves or inwardly projecting flanges 68 and 70 extending inwardly from opposite sides of the inner surface of housing 50. Shelves 68 and 70 are disposed essentially in a common plane oriented transversely with respect to housing 50 and axis 52. Shelves 68 and 70 are spaced from one another in the common plane. Bars 46 and 48 each have a length greater than a distance d2 between shelves 68 and 70 and a width less than that distance. Intershelf distances d1 and d2 are preferably equal, shelves 62 and 64 being identical to and vertically aligned with shelves 68 and 70.

The lower surfaces of shelves 68 and 70, i.e., the surfaces facing opening 54, are abutment surfaces which engage lower bar 48 to prevent tool member 40 from being pushed back into housing 50 during use of the plunger assembly. Similarly, the upper surfaces of shelves 68 and 70, i.e., the surfaces facing plate 58, are abutment surfaces which engage upper bar 46 to prevent tool member 40 from falling out of the extended position during use of the plunger assembly.

Bars 46 and 48 define a slot 72 between them, the slot receiving shelves 62 and 64 in the retracted locked configuration of tool member 40 with respect to housing 50 (FIG. 3A). Slot 72 similarly receives shelves 68 and 70 in the extended locked configuration of tool member 40 with respect to housing 50 (FIG. 3D). In this manner bars 46 and 48 cooperate with shelves 62, 64 and 68, 70 to lock tool member 40 to housing 50 in retracted and extended positions of the tool member.

FIG. 3A shows the household implement resting on a horizontal surface, such as a bathroom floor, so that opening 54 is covered. In this rest position, both cup member 42 and housing 50 are in contact with the floor surface. In using the tool assembly 40 and housing 50 assembly of FIGS. 3A-3D, housing 50 is lifted by hand grip or handle 56 so that the housing is no longer resting on the floor surface. Housing 50 is not lifted so far, however, that a lower surface of bar 46 engages shelves 62 and 64. To that end, the width of slot 72 is slightly greater than the thickness of shelves 62 and 64.

Figure 3B:
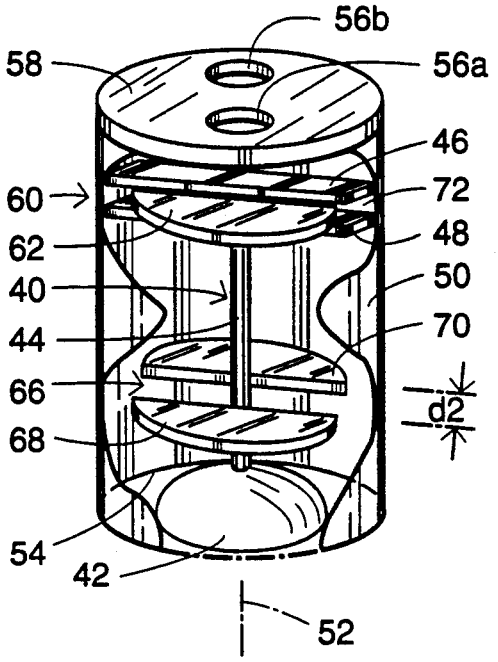
Figure 3C:
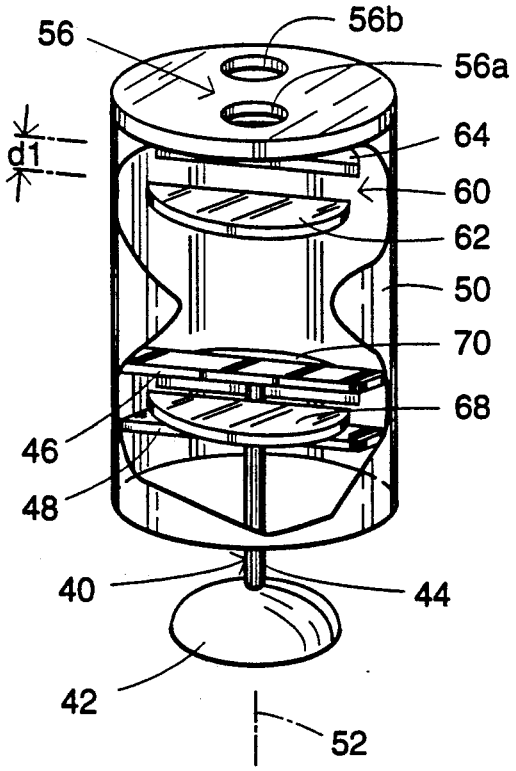
Figure 3D:
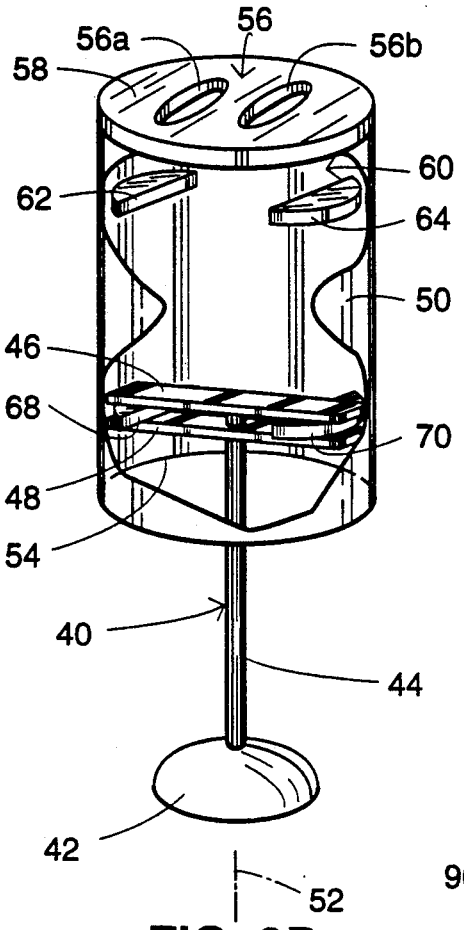

Upon the slight lifting of housing 50 via hand grip 56, housing 50 is twisted approximately 90° to a neutral position illustrated in FIG. 3B. At that juncture, hand grip 56 is manipulated to lift housing 50 a vertical distance so that tool member or plunger 40 extends from opening 54 in a neutral position, as illustrated in FIG. 3C. Then housing 50 is counter-rotated 90° back so that slot 72 receives shelves 68 and 70 to lock tool member 40 to housing 50.

Upon the locking of tool member 40 to housing 50 via locking mechanism 66, plunger 40 is used, for example, to unplug a drain. Subsequently, the steps of FIGS. 3A-3D are executed in reverse to return the implement to the locked storage configuration of FIG. 3A.

Figure 4:
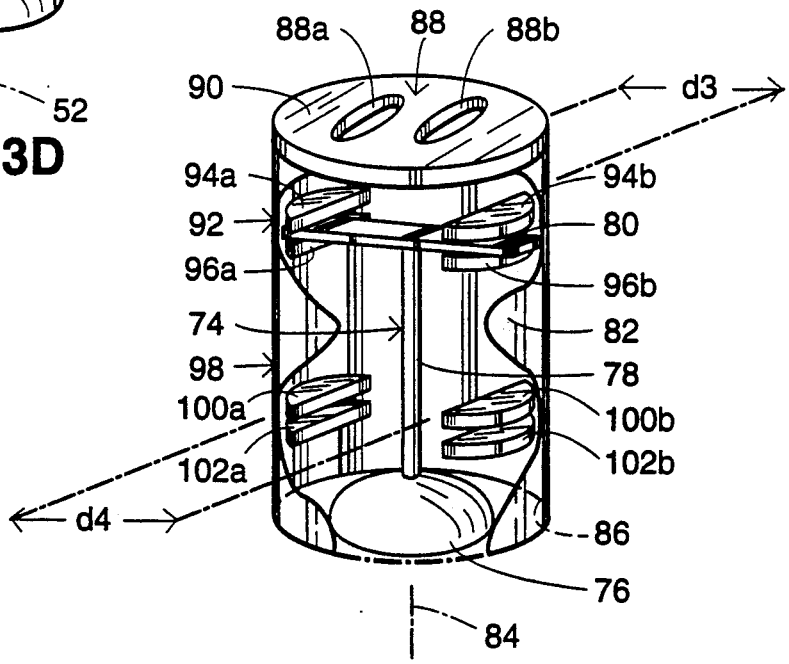
FIG. 4 is a schematic perspective view, partially broken away, of yet another plunger and casing assembly in accordance with the present invention, showing the assembly with a plunger retracted inside a casing or housing.

As illustrated in FIG. 4, another household implement comprises a tool member 74 including an operative element 76 in the form of a cup-shaped resilient member, an elongate rod or shaft 78 attached at one end to cup member 76, and a bar shaped flange 80 connected to rod 78 at an end opposite cup member 76, the bar extending substantially orthogonally or transversely with respect to rod 78. The implement of FIG. 4 additionally comprises a hollow housing or casing 82 having a longitudinal axis 84, an opening 86 at one end and a hand grip 88 in the form of a pair of slots or apertures 88*a* and 88*b* provided in a transversely oriented plate or panel 90 at an end of housing 82 opposite opening 86.

A first locking mechanism 92 is provided at the upper end of housing 82 proximately to hand grip 88. Locking mechanism 92 cooperates with bar 80 upon a rotation of tool member 74 from a retracted neutral position, to releasably hold tool member 74 in a retracted locked position to housing 82. Locking mechanism 92 includes two pairs of shelves or inwardly projecting formations 94*a*, 94*b* and 96*a*, 96*b* extending inwardly from opposite sides of an inner surface of housing 82. Shelves 94*a* and 94*b* are disposed essentially in a common plane oriented transversely with respect to housing 82 and axis 84, while shelves 96*a* and 96*b* are similarly disposed in a common plane parallel to the plane of shelves 94*a* and 94*b*. Shelves 94*a* and 94*b* are spaced from shelves 96*a* and 96*b* by a distance slightly greater than the width of bar 80; shelves 94*a* and 96*a* are vertically aligned with one another and shelves 94*b* and 96*b* are vertically aligned with one another. Bar 80 has a length greater than a common distance d3 between shelves 94*a* and 94*b* and shelves 96*a* and 96*b*.

A second locking mechanism 98 is provided at the lower end of housing 82 proximately to opening 86. Locking mechanism 98 cooperates with bar 80 upon a rotation of tool member 74 from an extended neutral position, to releasably hold tool member 74 in an extended locked position to housing 82. Locking mechanism 98 includes a first pair of shelves or inwardly projecting formations 100*a* and 100*b* extending inwardly from opposite sides of the inner surface of housing 82 and further includes a second pair of shelves or inwardly projecting formations 102*a* and 102*b* extending inwardly from opposite sides of the inner surface of housing 82 in vertical alignment with shelves 100*a* and 100*b*, respectively. The distance d4 between shelves 100*a* and 100*b* and between 102*a* and 102*b* is less than the length of bar 80 and greater than the width of that bar.

Shelves 94*a* and 96*a* and shelves 94*b* and 96*b* respectively define between them slots for receiving opposite ends of bar 80 to lock tool member 74 in the retracted storage position thereof. Shelves 100*a* and 102*a* and shelves 100*b* and 102*b* define between them slots for receiving bar 80 to lock tool member 74 in the extended configuration.

It is to be noted that uppermost shelves 94*a* and 94*b* serve as an arrest for preventing bar 80 from moving more than a predetermined distance beyond locking mechanism 92 in a direction opposite locking mechanism 98. Similarly, lowermost shelves 102*a* and 102*b* serve as an arrest for preventing bar 80 from moving and 102*b* serve as an arrest for preventing bar 80 from moving more than a predetermined distance beyond locking mechanism 98 in a direction opposite locking mechanism 92.

The implement of FIG. 4 functions in a manner essentially similar to the functioning of the plunger of FIGS. 3A-3D.

Figure 5:
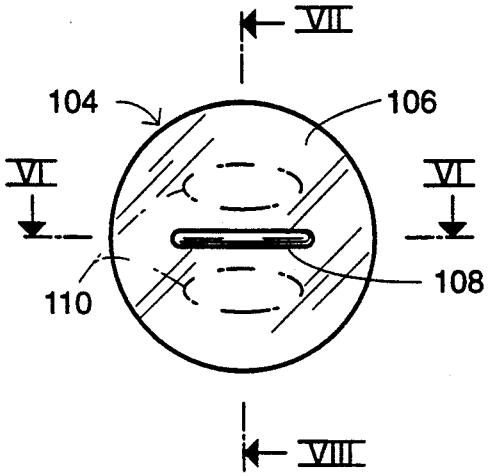
FIG. 5 is a schematic top view, on a reduced scale of a plunger casing of another plunger assembly in accordance with the present invention.

As illustrated in FIG. 5, another plunger assembly has a cylindrical casing or housing 104 an upper panel or wall 106 carrying a hand grip 108. Alternatively, upper panel or wall 106 is provided with a pair of oval apertures 110 which together define a hand grip.

Figure 6:
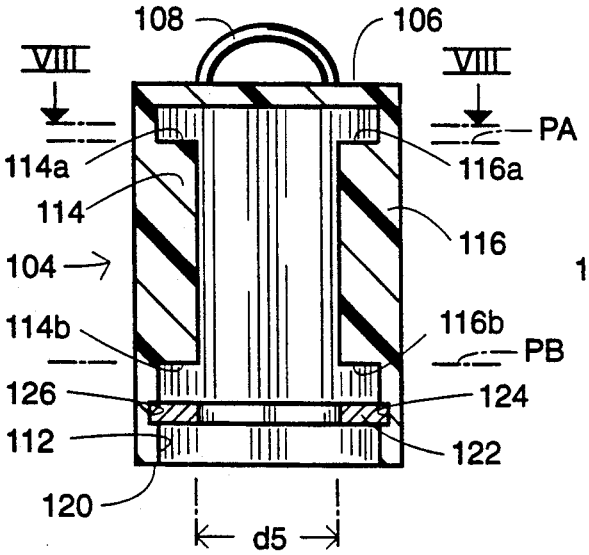
FIG. 6 is a schematic longitudinal cross-sectional view taken along line VI—VI in FIG. 5.
Figure 7:
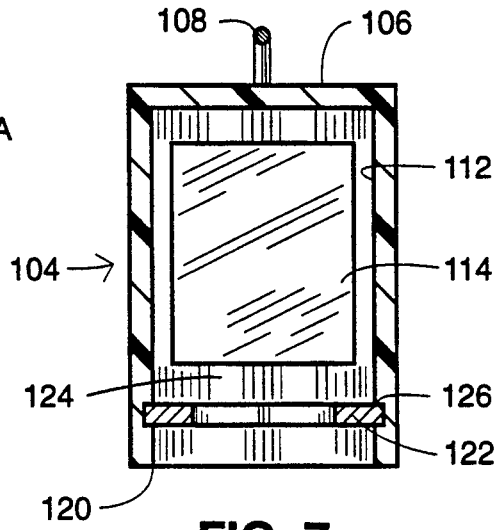
FIG. 7 is a schematic longitudinal cross-sectional view taken along line VII—VII in FIG. 5.
Figure 8:
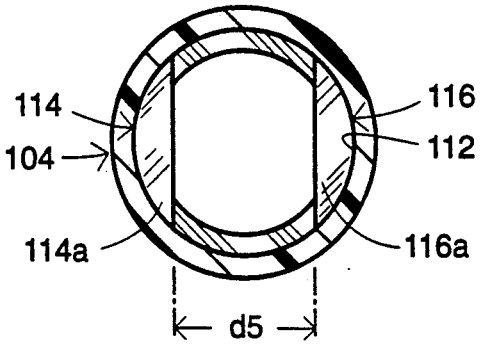
FIG. 8 is a schematic transverse cross-sectional view taken along line VIII—VIII in FIG. 6.

As further illustrated in FIGS. 6-8, casing 104 is provided along a cylindrical inner surface 112 with a pair of elongate, longitudinally extending, cylindrical segments 114 and 116. Segments 114 and 116 function as arrests for locking a tool member 118 (FIGS. 9A-9D) to the casing 104 in a retracted position (FIG. 9A) and an extended position (FIG. 9D). To that end, segments 114 and 116 define a first pair of planar abutment surfaces 114*a* and 116*a* disposed in a first plane PA extending transversely with respect to casing 104 and a second pair of planar abutment surfaces 114*b* and 116*b* disposed in a second plane PB oriented orthogonally relative to casing 104. Segments 114 and 116 and, concomitantly, surfaces 114*a* and 116*a* and surfaces 114*b* and 116*b*, are spaced a distance d5 from one another.

Casing 104 is open at a lower rim 120 to enable the extension and retraction of tool member 118 from the casing. An arrest in the form of a ring or annular shelf 122 is provided along inner surface 12 between rim 120 and abutment surfaces 114*b* define a slot or recess 124 for locking tool member 118 to casing 104, as described in detail hereinafter with reference to FIGS. 9A-9D. Ring 122 may be a slotted ring which is sufficiently collapsible to permit the insertion of the ring into casing 104. Ring 122 may be partially inserted in a snap-lock fit into an annular groove 126 provided in inner surface 112.

As illustrated in FIGS. 9A-9D, tool member 118 includes an operative element 128 in the form of a cup-shaped resilient member, an elongate rod or shaft 130 attached at one end to cup member 128, and a bar shaped flange 132 connected to rod 130 at an end opposite cup member 128. Bar 132 extends substantially orthogonally or transversely with respect to rod 130.

Figure 9A:
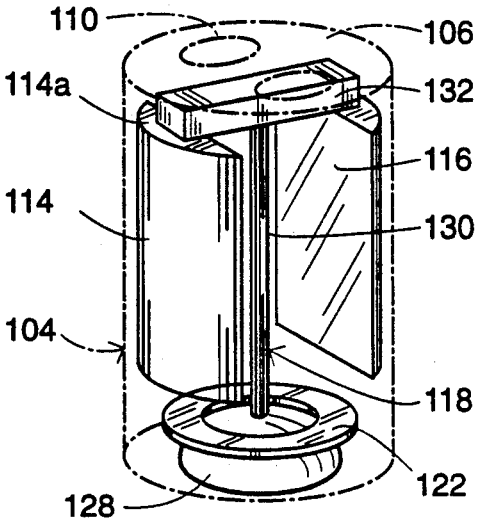
FIGS. 9A-9D are schematic broken-away perspective views of the plunger and casing assembly of FIGS. 5-8, showing successive stages in the use of the assembly.

Abutment or shelf surfaces 114*a* and 116*a* of arrests 114 and 116 cooperate with bar 132 upon a rotation of tool member 118 from a retracted neutral position (FIG. 9B), to releasably hold tool member 118 in a retracted locked position to casing 104 (FIG. 9A). Similarly, abutment or shelf surfaces 114*b* and 116*b* and ring 122 cooperate with bar 132 upon a rotation of tool member 118 from an extended position (FIG. 9C), to releasably hold tool member 118 in an extended locked position to casing 104 (FIG. 9D). Bar 132 has a length greater than distance d5 (FIGS. 6 and 8) between arrests 114 and 116 and a width less than that distance.

FIG. 9A schematically shows the household implement with rim 120 and cup member 130 resting on a horizontal surface, such as a bathroom floor (not shown). In using the tool member 118 and casing 104 assembly of FIGS. 9A–9D, casing 104 is lifted by hand grip or handle 108 or 110 so that casing 104 is no longer resting on the floor surface. Casing 104 is not lifted so far, however, that a lower surface of bar 132 engages abutment surfaces 114*a* and 116*a*.

Figure 9B:
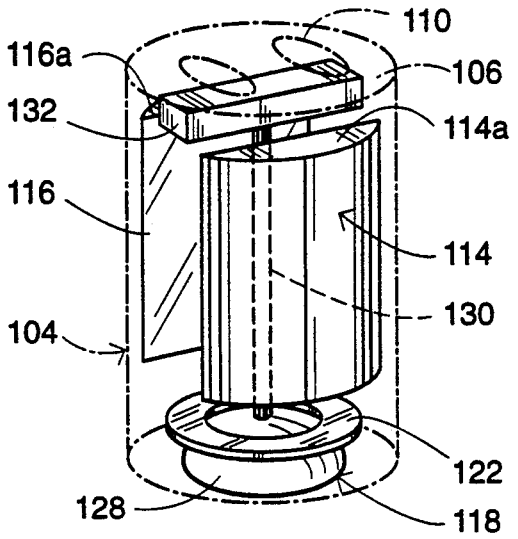
Figure 9C:
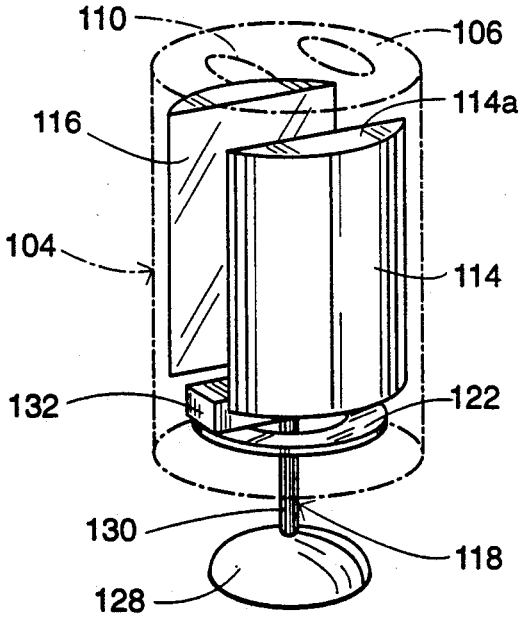
Figure 9D:
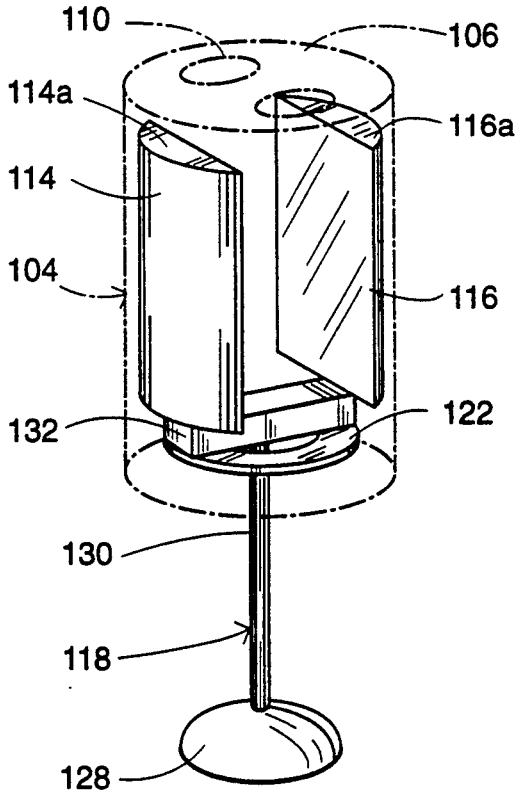

Upon the slight lifting of casing 104 via hand grip 108 or 110, casing 104 is twisted approximately 90° to a neutral position illustrated in FIG. 9B. At that juncture, hand grip 108 or 110 is manipulated to lift casing 104 a vertical distance so that tool member or plunger 118 extends from opening 54 in a neutral position, as illustrated in FIG. 9C. Then casing 104 is counterrotated 90° back so that slot 72 receives shelves 68 and 70 to lock tool member 118 to casing 104.

Upon the locking of tool member 118 to casing 104 via abutment surfaces 114*b* and 116*b*, ring 122, and bar 132, plunger 118 is used, for example, to unplug a drain. Subsequently, the steps of FIGS. 9A–9D are executed in reverse to return the implement to the locked storage configuration of FIG. 9A.

One skilled in the art will understand that housing 50 (FIGS. 3A–3D) and housing 82 (FIG. 4) are advantageously provided at their lower ends with abutment rings or shelves similar to ring 122 in FIGS. 6–9D. Such an abutment ring or shelf will serve to catch or engage bar 48 or 80, and thereby prevent tool member 40 or 74 from falling through opening 54 or 86, respectively, upon a lifting of housing 50 or 82 subsequent to a rotation of the housing to unlock the respective tool member therefrom.

Although the invention has been described in terms of particular embodiments and applications, one of ordinary skill in the art, in light of this teaching, can generate additional embodiments and modifications without departing from the spirit of or exceeding the scope of the claimed invention. For example, an uppermost pair of shelves and a lowermost pair of shelves may be replaced with plates or screens, inasmuch as it is not necessary for the single transverse bar to pass beyond the planes defined by such plates or screens.

Accordingly, it is to be understood that the drawings and descriptions herein are proferred by way of example to facilitate comprehension of the invention and should not be construed to limit the scope thereof.

What is claimed is:

1. A household implement comprising:

a tool member including an operative element and a rod attached at one end to said operative element;

a hollow housing having an opening at one end and a hand grip at an opposite end, said housing having a longitudinal axis;

mounting means for mounting said tool member to said housing for slidable motion between a retracted position inside said housing and an extended position wherein said operative element and a portion of said rod are outside of said housing; and locking means on said housing for releasably locking said tool member in said extended position, said locking means including:

a pair of arrests extending inwardly from opposite sides of an inner surface of said housing, said arrests defining a pair of abutment surfaces disposed essentially in a common plane oriented transversely with respect to said housing, said arrests being spaced from one another in said common plane; and a bar connected to said rod at an end thereof opposite said operative element, said bar extending orthogonally to said rod, said bar having a length greater than a distance between said abutment surfaces, said bar having a width less than said distance.

2. The implement defined in claim 1, further comprising additional locking means on said housing for locking said tool member in said retracted position.

3. The implement defined in claim 2 wherein said additional locking means includes a pair of additional arrests extending inwardly from opposite sides of an inner surface of said housing, said additional arrests being disposed essentially in a common plane oriented transversely with respect to said housing, said additional arrests being spaced from one another in such common plane by an additional distance less than said length of said bar and greater than said width of said bar.

4. The implement defined in claim 3 wherein said bar is one of a pair of bars connected to said rod at said end thereof opposite said operative element, said bars extending orthogonally to said rod, each of said bars having a length greater than said distance between said arrests, each of said bars having a width less than said distance, whereby said bars define a slot for receiving said arrests in a locked configuration of the implement.

5. The implement defined in claim 4 wherein said arrests are shelf-like flanges.

6. The implement defined in claim 2 wherein said arrests are elongate cylindrical segments extending along said opposite sides of said housing, said additional locking means including on said arrests a pair of additional abutment surfaces extending inwardly from opposite sides of said inner surface of said housing, said additional abutment surfaces being disposed essentially in a common plane oriented transversely with respect to said housing, said additional arrests being spaced from one another in such common plane by an additional distance less than said length of said bar and greater than said width of said bar.

7. The implement defined in claim 1 wherein said locking means further includes arresting means for preventing said bar from moving more than a predetermined distance beyond said locking means in a direction opposite said hand grip.

8. The implement defined in claim 7 wherein said arresting means includes a ring extending inwardly from said inner surface, said ring having an inner diameter, said bar having a length greater than said inner diameter.

9. The implement defined in claim 1 wherein said housing is cylindrical and wherein said inner surface is cylindrical.

10. The implement defined in claim 1 wherein said arrests are shelf-like flanges and said bar is one of a pair of bars connected to said rod at an end thereof opposite said operative element, said bars extending orthogonally to said rod, each of said bars having a length greater than said distance between said arrests, each of said bars having a width less than said distance, whereby said bars define a slot for receiving said arrests in a locked configuration of the implement.

11. The implement defined in claim 1 wherein said bar has a rectangular cross-section.

12. The implement defined in claim 1 wherein said tool member is a plunger and said operative element is a cup-shaped resilient member.

13. A household implement comprising:

a tool member including:

(i) an operative element;

(ii) an elongate rod attached at one end to said operative element; and (iii) a bar connected to said rod at an end opposite said operative element, said bar extending substantially orthogonally with respect to said rod;

a hollow housing having an opening at one end and a hand grip at an opposite end, said housing having a longitudinal axis;

first locking means at said opposite end of said housing for cooperating with said bar, upon a rotation of said tool member from a retracted neutral position, to releasably hold said tool member in a retracted locked position to said housing; and second locking means at said one end of said housing for cooperating with said bar, upon a rotation of said tool member from an extended neutral position, to releasably hold said tool member in an extended locked position to said housing, at least one of said first locking means and said second locking means including a pair of arrests extending inwardly from opposite sides of an inner surface of said housing, said arrests defining a pair of abutment surfaces disposed essentially in a common plane oriented transversely with respect to said housing, said abutment surfaces being spaced from one another in said common plane, said bar having a length greater than a distance between said abutment surfaces, said bar having a width less than said distance.

14. The implement defined in claim 13 wherein said one of said first locking means and said second locking means further includes arresting means for preventing said bar from moving more than a predetermined distance beyond said one of said first locking means and said second locking means in a direction opposite the other of said one of said first locking means and said second locking means.

15. The implement defined in claim 14 wherein said arrests are shelf-like flanges and wherein said arresting means includes a pair of additional shelf-like flanges extending inwardly from opposite sides of said inner surface, said additional flanges being disposed essentially in an additional common plane oriented transversely with respect to said housing, said additional flanges being spaced from one another in said additional common plane, said length of said bar being greater than an additional distance between said additional flanges, said width of said bar being less than said additional distance.

16. The implement defined in claim 13 wherein said arrests are elongate cylindrical segments extending along said opposite sides of said housing, said additional locking means including on said arrests a pair of additional abutment surfaces extending inwardly from opposite sides of said inner surface of said housing, said additional abutment surfaces being disposed essentially in a common plane oriented transversely with respect to said housing, said additional arrests being spaced from one another in such common plane by an additional distance less than said length of said bar and greater than said width of said bar.

17. The implement defined in claim 16 wherein said second locking means includes a ring extending inwardly from said inner surface, said ring being disposed on a side of said additional abutment surfaces opposite said hand grip, said ring having an inner diameter, said bar having a length greater than said inner diameter.

18. The implement defined in claim 13 wherein one of said first and said second locking means includes arresting means for preventing said bar from moving more than a predetermined distance beyond said one of said first locking means and said second locking means in a direction opposite the other of said first locking means and said second locking means.

19. The implement defined in claim 18 wherein said one of said first locking means and said second locking means is said second locking means and wherein said arresting means includes a ring extending inwardly from said inner surface, said ring having an inner diameter, said bar having a length greater than said inner diameter.

20. The implement defined in claim 13 wherein said bar is the only bar attached to said rod, said one of said first locking means and said second locking means further including a pair of second arrests extending inwardly from opposite sides of said inner surface of said housing, said second arrests defining a second pair of abutment surfaces disposed essentially in a second common plane oriented transversely with respect to said housing, said second abutment surfaces being spaced from one another in said second common plane, said length of said bar being greater than a second distance between said second abutment surfaces, said width of said bar being less than said second distance.

21. The implement defined in claim 13 wherein said tool member is a plunger and said operative element is a cup-shaped resilient member.

22. A method for executing a household chore, comprising the steps of:

lifting up a housing by a handle provided at an upper end thereof;

extending, from an opening in a lower end of said housing, a tool member disposed inside said housing prior to said step of lifting;

rotating said tool member with respect to said housing;

upon said step of rotating, locking, to formations on opposite sides of said housing, opposite ends of a bar connected to said tool member and extending transversely relative to said housing;

manipulating said housing and said tool member via said handle to perform a task to which said tool member is adapted;

upon completion of said task, again rotating said tool member with respect to said housing, thereby unlocking said tool member from said housing;

retracting said tool member back into said housing; and placing said housing upon a horizontal surface so that said opening is covered and said tool member is again contained inside said housing.

23. The method defined in claim 22, further comprising the step of also rotating said tool member with respect to said housing prior to said step of extending, thereby unlocking said tool member from said housing.

24. The device defined in claim 23 wherein said step of also rotating is executed when said housing is lifted a short distance from a horizontal surface, thereby using friction to maintain said tool member in a relatively stationary position during a manual twisting of said housing.

25. The method defined in claim 22 wherein said bar is one of two bars attached to said tool member at one end thereof and extending parallel to one another, said step of locking including the step of inserting between said bars, at opposite ends thereof, flanges extending inwardly from opposite sides of an inner surface of said housing.

26. A household implement comprising:

a tool member including:

(i) an operative element;

(ii) an elongate rod attached at one end to said operative element; and (iii) a bar connected to said rod at an end opposite said operative element, said bar extending substantially orthogonally with respect to said rod;

a hollow housing having an opening at one end and a hand grip at an opposite end, said housing having a longitudinal axis;

first locking means at said opposite end of said housing for cooperating with said bar, upon a rotation of said tool member from a retracted neutral position, to releasably hold said tool member in a retracted locked position to said housing; and second locking means at said one end of said housing for cooperating with said bar, upon a rotation of said tool member from an extended neutral position, to releasably hold said tool member in an extended locked position to said housing said second locking means including arresting means for preventing said bar from moving more than a predetermined distance beyond said second locking means in a direction opposite said first locking means, said arresting means including a ring extending inwardly from said inner surface, said ring having an inner diameter, said bar having a length greater than said inner diameter.

* * * * *